US008418310B2

(12) United States Patent
Krebs

(10) Patent No.: US 8,418,310 B2
(45) Date of Patent: Apr. 16, 2013

(54) PIVOTING EXTRACTOR NOZZLE

(75) Inventor: Alan J. Krebs, Pierson, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 242 days.

(21) Appl. No.: 12/950,444

(22) Filed: Nov. 19, 2010

(65) Prior Publication Data

US 2011/0119861 A1 May 26, 2011

Related U.S. Application Data

(60) Provisional application No. 61/264,546, filed on Nov. 25, 2009.

(51) Int. Cl.
*A47L 5/30* (2006.01)

(52) U.S. Cl.
USPC ..... 15/320; 15/322; 15/362; 15/369

(58) Field of Classification Search ..... 15/320, 15/322, 354, 355, 360, 369, 362; *A47L 5/30*
See application file for complete search history.

(56) References Cited

U.S. PATENT DOCUMENTS

| | | | |
|---|---|---|---|
| 1,596,041 | A | 8/1926 | Young |
| 3,497,903 | A | 3/1970 | Johsson |
| 3,660,864 | A | 5/1972 | Schwartz |
| 3,768,114 | A | 10/1973 | Schwartz |
| 3,815,171 | A | 6/1974 | Carr et al. |
| 3,894,308 | A | 7/1975 | Carr |
| 4,100,644 | A | 7/1978 | Johansson |
| 5,347,678 | A | 9/1994 | Williams et al. |
| 5,553,349 | A | 9/1996 | Kilstrom et al. |
| 5,557,822 | A | 9/1996 | Yagi et al. |
| 5,867,861 | A | 2/1999 | Kasen et al. |
| 6,131,237 | A | 10/2000 | Kasper et al. |
| 2007/0226943 | A1 | 10/2007 | Lenkiewicz et al. |
| 2008/0016642 | A1 | 1/2008 | Thomas |

FOREIGN PATENT DOCUMENTS

| | | | |
|---|---|---|---|
| EP | 0679363 | A3 | 11/1995 |
| EP | 1989985 | A1 | 11/2008 |

*Primary Examiner* — David Redding
(74) *Attorney, Agent, or Firm* — McGarry Bair PC

(57) ABSTRACT

An extractor comprises a foot assembly supported by at least one wheel at a rearward portion thereof and at least one rotatable agitator at a forward portion thereof, a fluid delivery system, a fluid recovery system and an extension with a first end aligned with an inlet for an extraction path and a second end in register with a surface to be cleaned. The foot assembly can be traversed over the surface to be cleaned in alternating forward and rearward movements. Movement of the foot assembly in a rearward direction supports the forward portion of the foot assembly on the extension in a first position and the at least one agitator and movement of the foot assembly in a forward direction shifts support of the forward portion of the foot assembly off of the extension in a second position.

19 Claims, 5 Drawing Sheets

PIVOTING EXTRACTOR NOZZLE

CROSS-REFERENCE TO RELATED APPLICATION

This application claims the benefit of U.S. Provisional Patent Application No. 61/264,546, filed Nov. 25, 2009, which is incorporated herein by reference in its entirety.

BACKGROUND

A wet extractor is a common device for cleaning a surface by delivering a cleaning fluid to a surface to be cleaned and removing the cleaning fluid and any debris from the surface. Some examples of wet extractors are disclosed in commonly assigned U.S. Pat. No. 6,131,237 to Kasper et al. and U.S. Patent Publication No. 2007/0226943 to Lenkiewicz et al.

U.S. Pat. No. 3,815,171 to Carr et al. discloses a suction nozzle configured for attachment to a vacuum hose for cleaning a carpet or rug. The nozzle comprises an inlet fluidly connected to a suction chamber portion. A brush unit comprising bristles projects below the inlet. The nozzle further comprises a pivotable rake that comprises a plurality of hollow tines fluidly connected to the suction chamber such that when the nozzle is pulled rearwardly, the rake automatically pivots about a hinge rod into an operative position where suction is drawn through the hollow tines and when the nozzle is pushed forwardly, the rake automatically pivots into a non-operative position.

U.S. Pat. No. 4,100,644 to Johansson discloses a vacuum cleaner nozzle comprising a rake-like part for cleaning a surface. The rake-like part comprises a plurality of tubular teeth forming air passages sharing a common air channel. When the nozzle is moved rearwardly, the teeth engage with a surface to be cleaned and are rotated into a lowered position such that the air channel is fluidly coupled with the suction channel via a hole. Movement of the nozzle in a forward direction retracts the teeth into the nozzle whereby a suction opening is fluidly coupled with the suction channel via a second air channel.

U.S. Patent Publication No. 2008/0016642 to Thomas discloses a spray extraction nozzle including a suction duct with a suction inlet configured to contact a surface to be cleaned. An adapter is pivotally mounted near the suction inlet and configured to pivot between an operating position where the adapter contacts the surface and a rest position where the adapter is pivoted away from the suction inlet and out of contact with the surface. The nozzle further comprises a releasable locking means for selectively locking the adapter in the operating position.

BRIEF SUMMARY

According to one embodiment, the invention comprises an extractor comprising a foot assembly supported by at least one wheel at a rearward portion thereof and at least one agitator at a forward portion thereof, a fluid delivery system, a fluid recovery system and an extension with a first end aligned with an inlet for an extraction path and a second end in register with a surface to be cleaned. The foot assembly can be traversed over the surface to be cleaned in alternating forward and rearward movements. Movement of the foot assembly in a rearward direction supports the forward portion of the foot assembly on the extension in a first position and the at least one agitator and movement of the foot assembly in a forward direction shifts support of the forward portion of the foot assembly off of the extension in a second position.

DETAILED DESCRIPTION

Figure 1:
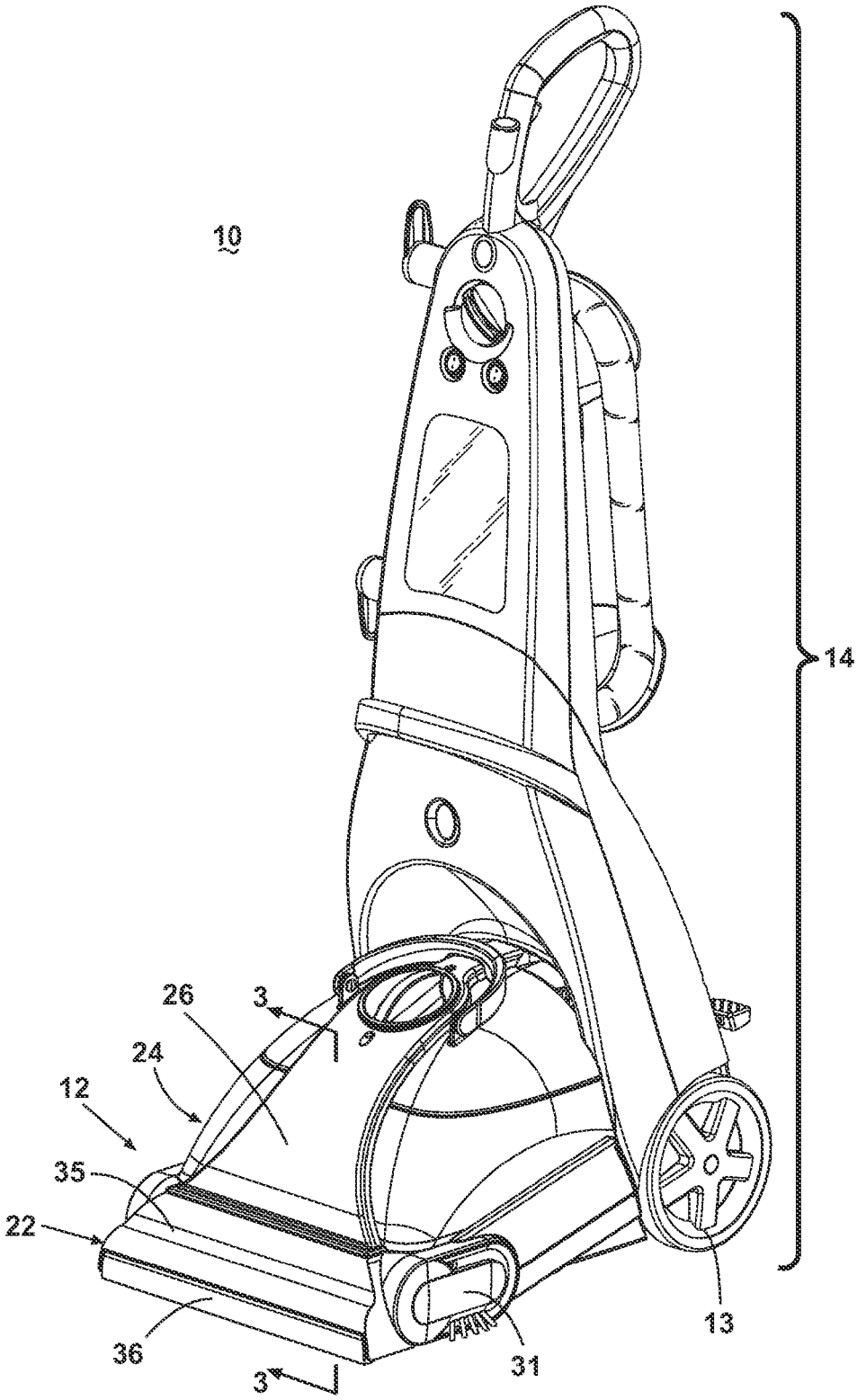
FIG. 1 is a front perspective view of an extractor according to one embodiment of the invention.

The invention generally relates to an apparatus for cleaning a surface and more specifically to a wet extractor. Referring to the figures, and in particular to FIGS. 1 and 2, an upright extractor 10 can comprise a foot assembly 12 having a pair of wheels 13 located at a rear portion of the foot assembly 12 and a handle assembly 14 pivotably mounted to the foot assembly 12 for directing the extractor 10 across a surface to be cleaned. The upright extractor 10 can be any suitable type of extractor and can comprise one or more features and operations common in extractors, such as those described in U.S. Pat. No. 6,131,237 to Kasper et al. and U.S. Patent Publication No. 2007/0226943 to Lenkiewicz et al. Such well-known features and operations will not be described in detail herein, except as otherwise necessary for a complete understanding of the invention. While the invention is described in the context of the upright extractor 10, it is within the scope of the invention for any suitable type of extraction device to be used.

Figure 2:
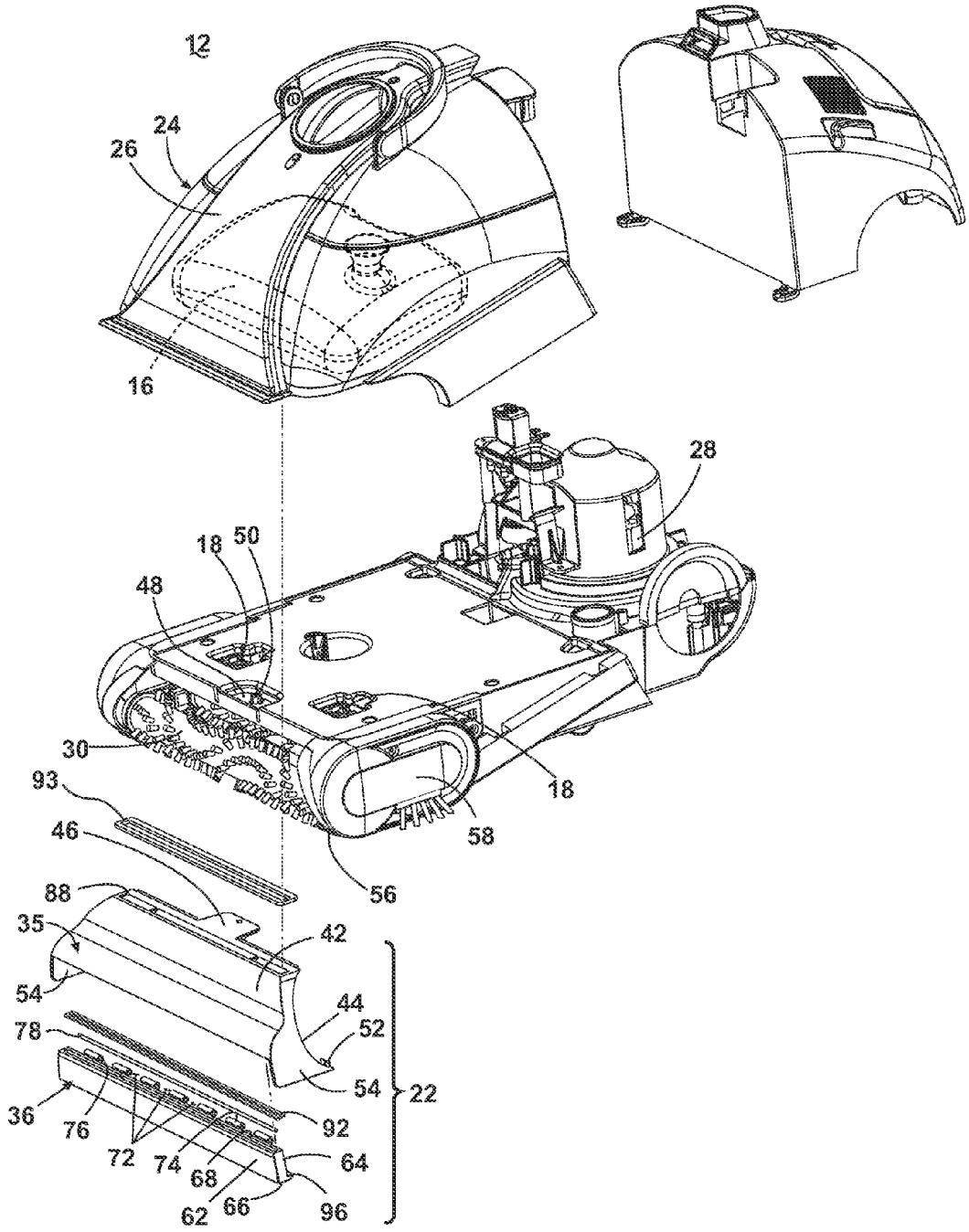
FIG. 2 is a partial exploded perspective view of a foot assembly of FIG. 1.

Referring now to FIG. 2, the upright extractor 10 can comprise a fluid delivery system for storing and delivering a cleaning fluid to the surface to be cleaned and a fluid recovery system for extracting and storing the dispensed cleaning fluid and debris from the surface to be cleaned. The components of the fluid delivery system and the fluid recovery system can be supported by either or both the foot assembly 12 and the handle assembly 14. In the illustrated embodiment, the components are primarily supported by the foot assembly 12.

The fluid delivery system comprises a fluid supply tank 16 for storing a supply of cleaning fluid, a fluid distributor 18 for depositing fluid onto the cleaning surface, and a fluid conduit (not shown) between the fluid supply tank 16 and the fluid distributor 18. Various combinations of optional components can be incorporated into the fluid delivery system such as a conventional fluid pump, a heater, or fluid control and mixing valves as is commonly known in the art.

Still referring to FIG. 2, the fluid recovery system can comprise an extraction path in the form of a suction nozzle 22 extending towards a surface to be cleaned, a recovery tank 24 and a working air conduit 26 in fluid communication with the suction nozzle 22 and the recovery tank 24. The fluid recovery system can also comprise a motor/fan assembly 28 in fluid communication with the recovery tank 24 and configured to generate a working airflow to draw liquid and entrained debris through the suction nozzle 22 and into the recovery tank 24.

Figure 3:
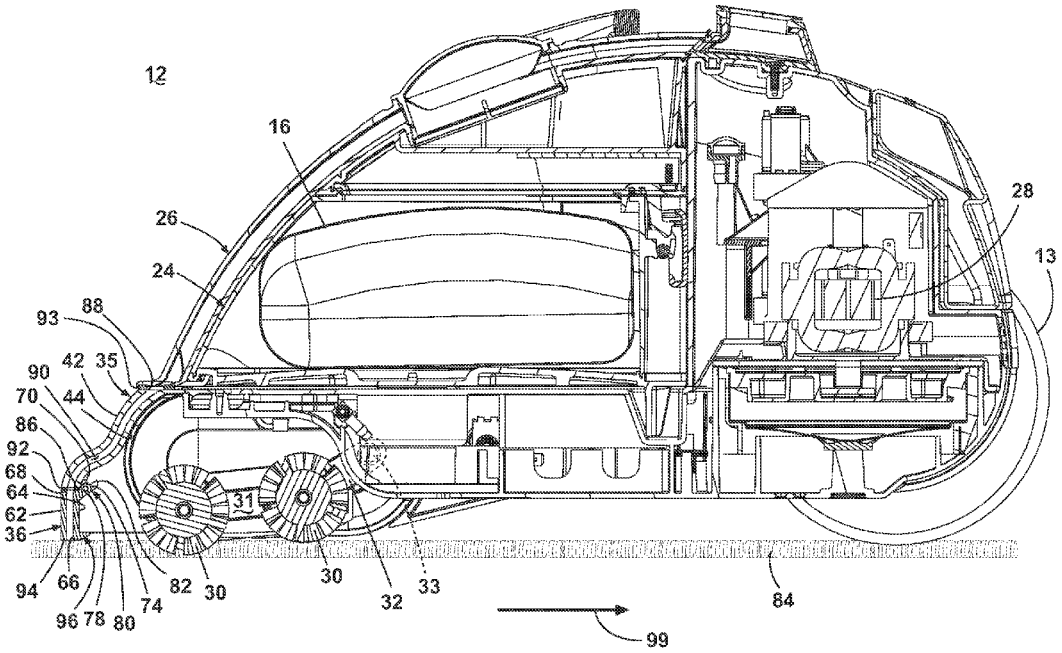
FIG. 3 is a cross-sectional view of the foot assembly of FIG. 1 taken along the line 3-3 illustrating a nozzle assembly in an engaged position during a rearward cleaning stroke.

Referring now to FIGS. 2 and 3, a pair of conventional rotating agitators 30 can be rotatably mounted beneath the foot assembly 12 within a brush chamber 31. The agitators 30 can be mounted between a pair of brush arms 32 pivotably mounted to the foot assembly 12 by a brush arm pivot 33. The angular rotation of the brush arm 32 about the corresponding brush arm pivot 33 can be limited by bosses (not shown) protruding from within the brush chamber 31. Alternatively, the agitators 30 can be rotatably mounted between vertically fixed bearings (not shown) secured within the brush chamber 31. The agitators 30 can be operably connected to a drive motor (not shown) via a conventional timing belt (not shown) for agitating the surface to be cleaned as is commonly known in the art. It is also within the scope of the invention for the extractor 10 to include any number of rotating agitators and/or a fixed agitator assembly.

The suction nozzle 22 can comprise a first nozzle portion 35 fluidly coupled with the working air conduit 26 and a nozzle extension 36 that can selectively fluidly couple the first nozzle portion 35 with a surface to be cleaned. The first nozzle portion 35 can have a pair of opposing front and rear walls 42 and 44, respectively. The first nozzle portion 35 can be fixed to the foot assembly 12 through an attachment tab 46 extending from an upper portion of the rear wall 44. The tab 46 can be secured to a mating pocket 48 on the foot assembly 12 via a mechanical fastener 50, such as a screw or pin, or any suitable non-mechanical fastener, such as an adhesive or weld, for example. The first nozzle portion 35 can also be secured to the foot assembly 12 via retention hooks 52 that protrude upwardly from the end of a pair of legs 54 provided at the lateral sides of the first nozzle portion 35. The hooks 52 can be configured to be received within mating slots 56 formed in a forward portion of a side wall of end caps 58 that are secured to the foot assembly 12 on either side of the brush chamber 31.

The nozzle extension 36 can comprise a pair of opposed front and rear walls 62, 64 defining a nozzle extension inlet 66 that can be selectively moved adjacent to a surface to be cleaned and a nozzle extension outlet 68. The nozzle extension 36 can have any suitable length for engaging a surface to be cleaned. Spaced upper hinge tenons 70 can protrude from the rear wall 44 of the first nozzle portion 35 (FIG. 3) and are configured to be received within slots 72 formed between lower hinge tenons 74 that can protrude outwardly from the rear wall 64 of the nozzle extension 36. The upper and lower hinge tenons 70, 74 can be configured to interlock such that central bores 76 within each lower hinge tenon 74 and central bores (not shown) within each upper hinge tenon 70 can be axially aligned for receiving a hinge pin 78. The upper and lower hinge tenons 70, 74 are configured such that they can rotate about the hinge pin 78 when the hinge pin 78 is received by the central bores of the upper and lower hinge tenons 70, 74, thus forming a pivot bearing 80 between the first nozzle portion 35 and the nozzle extension 36. The pivot bearing 80 permits the nozzle extension 36 to pivot with respect to the first nozzle portion 35. The hinge pin 78 can be retained in place by a knurled end (not shown) that is press fit within a pocket (not shown) in the first nozzle portion 35. Alternatively, the hinge pin 78 can be retained in place with a mechanical fastener, heat stake, adhesive, or other conventional fastener.

Figure 4:
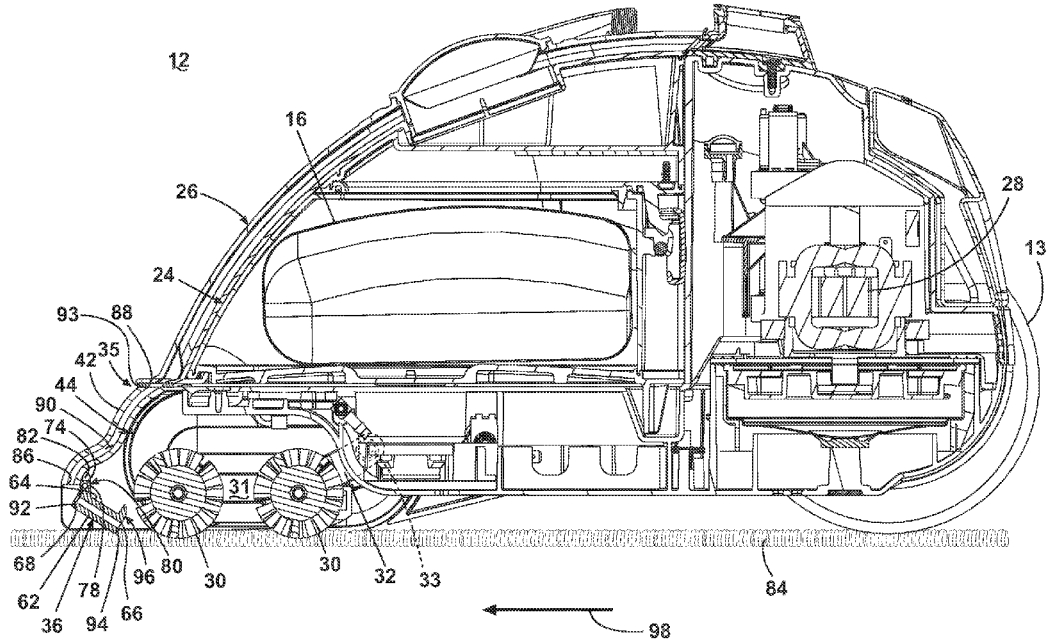
FIG. 4 is a cross-sectional view of the foot assembly of FIG. 1 taken along the line 3-3 illustrating a nozzle assembly in a retracted position during a forward cleaning stroke.

Referring now to FIGS. 3 and 4, one or more of the lower hinge tenons 74 can have a rotation limiter 82 protruding from an outer barrel portion of the lower hinge tenon 74 to limit the degree of rearward rotation of the extension nozzle 36. The rotation limiters 82 can comprise a plurality of short ribs that are configured to contact the rear wall 44 of the first nozzle portion 35 when the nozzle extension 36 is pivoted rearwardly to a retracted position during a forward cleaning stroke as illustrated in FIG. 4. For example, the rotation limiters 82 can limit the rotation angle to a maximum angular range of 15-70 degrees from vertical, which can promote pivoting of the nozzle extension 36 forward into the engaged position during a backward cleaning stroke as shown in FIG. 3.

As illustrated in FIG. 3, when the nozzle extension 36 is in the engaged position in which the nozzle extension inlet 66 is in fluid communication with a surface 84, the nozzle extension outlet 68 can also be in fluid communication with a first nozzle portion inlet 86 of the first nozzle portion 35. The first nozzle portion 35 can also be provided with a first nozzle portion outlet 88 in fluid communication with the working conduit 26. In this manner, the first nozzle portion 35 and the nozzle extension 36 can define a fluid flow path 90 from the surface 84 to the working conduit 26.

The nozzle 22 can also be provided with a seal 92 to selectively seal the nozzle extension outlet 68 with the first nozzle portion inlet 86 when the nozzle extension 36 is engaged with the surface 84, such as is illustrated in FIG. 3. The seal 92 can be affixed to the nozzle extension outlet 68 or, alternatively, the seal 92 can be affixed to the first nozzle portion inlet 86. The seal 92 can be a resilient seal and can comprise an over-molded elastomeric bead that extends around the perimeter of the nozzle extension outlet 68 or the first nozzle portion inlet 86. Alternative, non-limiting seal geometries are also contemplated, non-limiting examples of which include a plurality of beads having a semi-circular, oval, or triangular cross-section extending around the nozzle extension outlet 68 or the first nozzle portion inlet 86, arcuate resilient flaps, or a pleated accordion bellows boot extending between the first nozzle portion 35 and the nozzle extension 36.

Alternatively, adhesive backed resilient foam seals can be coupled with the nozzle extension outlet 68 or first nozzle portion inlet 86 to provide the seal 92. In yet another alternative configuration, the seal 92 can be eliminated altogether and replaced by downwardly chamfered faces formed around the nozzle extension outlet 68 that are configured to be selectively received within inwardly chamfered faces formed around the first nozzle portion inlet 86. When the nozzle extension 36 is in its engaged position, the downwardly chamfered faces can seal against the inwardly chamfered faces and permit a fluid connection between the first nozzle portion 35 and the nozzle extension 36.

The nozzle 22 can also be provided with a second seal 93 to selectively seal the first nozzle portion outlet 88 with the working air conduit 26. The seals 92, 93 between the working air conduit 26, the first nozzle portion 35 and the nozzle extension 36 can be provided to minimize leakage from the fluid flow path 90 during an extraction process as fluid is extracted from the surface 84 through the nozzle extension 36 and the first nozzle portion 35. It is also within the scope of the invention for the nozzle 22 to not comprise any seals.

The nozzle extension 36 can also comprise a gliding surface 94 at least partially surrounding the extension nozzle inlet 66 and a cam surface 96 along at least a portion of the length of the rear wall 64. The cam surface 96 can have any suitable shape, but is illustrated as having an upwardly radiused portion that extends from the rear wall 64 providing a curved leading edge during a rearward cleaning stroke. The cam surface 96 can facilitate movement of the lower nozzle segment over the surface being cleaned during the course of a rearward cleaning stroke of the extractor 10 (FIG. 3). The curved leading edge of the cam surface 96 can also prevent the nozzle extension inlet 66 from catching or snagging on carpet fibers or bouncing across the cleaning surface. Alternatively, the cam surface 96 can be in the form of an upwardly chamfered wall.

In operation, the upright extractor 10 can be prepared for use by filling the supply tank 16 with water and/or cleaning fluid and coupling it with the foot assembly 12. A user can then connect the extractor 10 to a line power supply and actuate the power switch (not shown) to energize the motor/fan assembly 28, agitator motor (not shown), as well as any additional optional components within the fluid delivery system such as optional pumps, valves, or a heater. The motor/fan assembly 28 can generate a working air flow that is drawn into the nozzle extension inlet 66 of the suction nozzle 22, through the working air conduit 26, into a recovery tank 24 where fluid and debris can be separated from the working air stream and deposited in the recovery tank 24, and finally into the motor/fan assembly 28. The working air stream can flow through the motor/fan assembly 28 and can be exhausted to atmosphere through conventional vents (not shown) in the foot assembly 12.

Referring now to FIG. 4, on a forward cleaning stroke, a user can push the handle assembly 14 to maneuver the foot assembly 12 forward along the surface 84, as illustrated by arrow 98. As the extractor 10 moves forward, a front edge of the front gliding surface 94 can engage the surface 84, which can provide a force to cause the nozzle extension 36 to pivot rearward relative to the direction of travel of the extraction cleaner 10 about the pivot bearing 80. As the nozzle extension 36 rotates rearward, the nozzle extension inlet 66 can rotate away from the surface 84, disrupting the fluid flow path 90 between the nozzle extension outlet 68 and the nozzle first portion inlet 86. Rotation of the nozzle extension 36 can also disconnect the nozzle extension outlet 68 from the first nozzle portion inlet 86, disrupting the working air flow through the suction nozzle 22, interrupting suction adjacent the surface 84 and therefore interrupting extraction of fluid and/or debris from the surface 84. The rotation limiters 82 can contact the rear wall 44 of the first nozzle portion 35 when the nozzle extension 36 rotates away from the surface 84, limiting the extent of rotation to the retracted position illustrated in FIG. 4.

Cleaning fluid from the fluid supply tank 16 can be selectively dispensed onto the surface 84 through the fluid distributor 18 during the cleaning process when a user actuates a trigger (not shown) on the handle assembly 14. The rotation of the nozzle extension 36 to its retracted position during the forward stroke can provide time for the dispensed cleaning fluid to dwell on the surface 84 while the agitators 30 agitate the surface 84 before the fluid is extracted through the nozzle 22 on the subsequent rearward stroke (FIG. 3), which can enhance the cleaning performance.

On a rearward cleaning stroke, as illustrated in FIG. 3, a user can pull the extractor 10 rearwardly along the surface 84, as illustrated by arrow 99. As the foot assembly 12 moves rearward, the front gliding surface 94 can engage the surface 84, resulting in a forward rotation of the nozzle extension 36 about the pivot bearing 80 opposite the direction of travel of the extractor 10. The nozzle extension inlet 66 can rotate forward until it is adjacent to the surface 84, compressing the seal 92 between the nozzle extension outlet 68 and first nozzle portion inlet 86. In this manner, the working air flow through the first nozzle portion 35 can be re-coupled with the nozzle extension 36, thus restoring suction adjacent to the surface 84. As the foot assembly 12 continues to move rearward, the cam surface 96 can glide along the surface and can prevent the nozzle extension inlet 66 from snagging the surface or creating undesirable bouncing or vibration of the nozzle extension 36 against the surface 84. When the nozzle extension 36 is in the engaged position, fluid and/or debris can be extracted by the working air flow suction through the fluid flow path 90 within the suction nozzle 22 and into the recovery tank 24 where fluid and debris can be separated from the working air flow and deposited in the recovery tank 24 for later disposal.

Figure 5A:
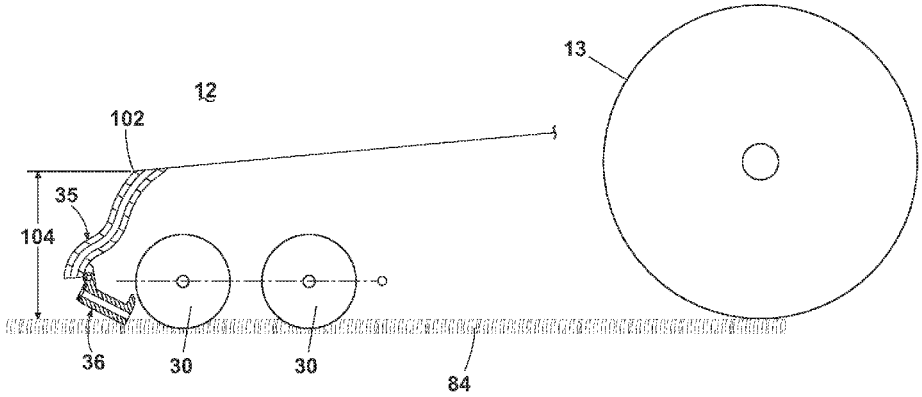
FIGS. 5A and 5B are schematic views of the foot assembly of FIG. 1 illustrating the height of a forward portion of the foot assembly relative to a surface to be cleaned during a forward and rearward cleaning stroke, respectively.
Figure 5B:
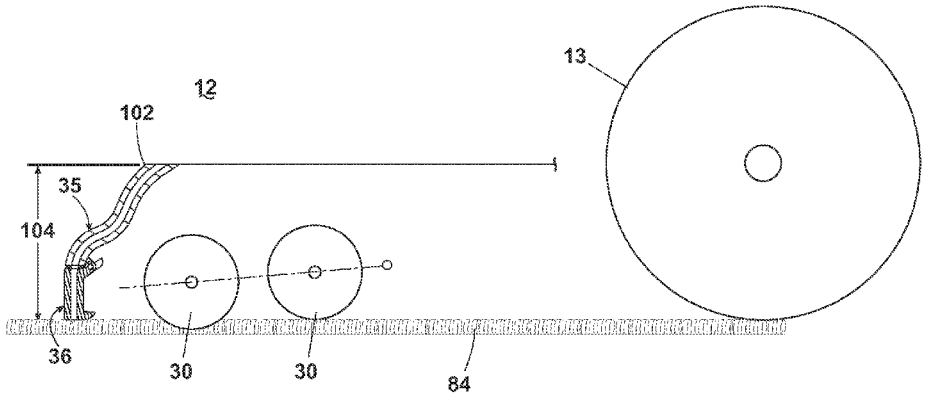

FIGS. 5A and 5B schematically illustrate the change in height of the foot assembly 12 relative to the surface 84 that can occur when the extractor 10 is moved in a forward stroke and a rearward stroke. Referring to FIG. 5A, when the nozzle extension 36 is in the retracted position during a forward stroke, the foot assembly 12 can rotate about the axis of the wheels 13 such that a front portion 102 of the foot assembly 12, opposite the wheels 13, is tilted toward the surface 84 providing a distance 104 between the surface 84 and front portion 102 of the foot assembly 12 that can vary depending on the length of the nozzle extension 36. When the nozzle extension 36 is in the engaged position during a subsequent rearward stroke, as illustrated in FIG. 5B, the foot assembly 12 can rotate about the axis of the wheels 13 such that the front portion 102 of the foot assembly 12 is tilted away from the surface 84 such that the distance 104 is greater than during the forward stroke. Because the agitators 30 are mounted to a pair of pivotable brush arms 32 (FIG. 3), the agitators 30 can move relative to the foot assembly 12 such that they maintain at least some contact with the surface 84 even as the distance 104 between the surface 84 and the front portion 102 of the foot assembly 12 changes during a forward and rearward stroke.

Because the agitators 30 can maintain contact with the surface 84 during both the forward and rearward strokes, when the nozzle extension 36 is in the engaged position, some of the weight of the front portion 102 of the foot assembly 12 can be shifted from the agitators 30 to the nozzle extension 36, whereas when the nozzle extension 36 is in the retracted position, the weight of the front portion 102 of the foot assembly 12 can be shifted to the agitators 30. In this manner, the pressure applied by the agitators 30 and nozzle extension 36 can be varied during forward and rearward strokes as the weight of the foot assembly 12 is shifted as the nozzle extension 36 moves between the retracted and engaged positions. Increased pressure applied by the agitators 30 during the forward stroke can enhance engagement of the agitators 30 with the surface 84 which can lead to improved cleaning performance. Furthermore, increased pressure applied by the nozzle extension 36 during a rearward stroke can enhance engagement of the nozzle extension inlet 66 with the surface 84 which can lead to improved fluid extraction and liquid recovery from the cleaning surface 84.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims. For example, the sequence of steps depicted in each method described herein is for illustrative purposes only, and is not meant to limit the disclosed methods in any way as it is understood that the steps may proceed in a different logical order or additional or intervening steps may be included without detracting from the invention.

What is claimed is:

1. An extractor comprising:

a foot assembly supported by at least one wheel at a rearward portion thereof and at least one rotatable agitator at a forward portion thereof, wherein the foot assembly is traversed over a surface to be cleaned in alternating forward and rearward movements;

a fluid delivery system for delivering a cleaning fluid to the surface to be cleaned;

a fluid recovery system for extracting fluid and debris from the surface to be cleaned through an extraction path to a recovery tank; and an extension with a first end aligned with an inlet for the extraction path and a second end in register with the surface to be cleaned;

wherein movement of the foot assembly in a rearward direction supports the forward portion of the foot assembly on the extension in a first position and movement of the foot assembly in a forward direction shifts support of the forward portion of the foot assembly off of the extension in a second position; and wherein the extractor is an upright extractor having a handle assembly pivotally coupled to the foot assembly.

2. The extractor of claim 1 wherein, in the first position, the first end of the extension is fluidly coupled with the inlet of the extraction path, and in the second position, the first end of the extension is disengaged from the inlet.

3. The extractor of claim 1 and further comprising a sealing member positioned between the first end of the extension and the inlet of the extraction path.

4. The extractor of claim 1 and further comprising a hinge pivotably mounting the extension to the foot assembly between at least the first and second positions.

5. The extractor of claim 4 and further comprising a position limiter associated with the hinge to prevent rotational movement of the extension beyond the second position during forward movement of the foot assembly.

6. The extractor of claim 4 and further comprising a cam located adjacent the second end of the extension for biasing the extension into the first position against the surface being cleaned during rearward movement of the foot assembly.

7. The extractor of claim 6 wherein the cam comprises an arcuate surface extending rearwardly and upwardly from the second end of the extension.

8. The extractor of claim 6 and further comprising a seal compressed between the first end of the extension and the inlet for the extraction path when the extension is in the first position.

9. The extractor of claim 1 wherein in the first position, fluid and debris are being extracted from the surface to be cleaned through the extraction path and in the second position, fluid and debris is not extracted from the surface to be cleaned through the extraction path.

10. An extractor comprising:

a foot assembly supported by at least one wheel at a rearward portion thereof and at least one rotatable agitator at a forward portion thereof, wherein the foot assembly is traversed over a surface to be cleaned in alternating forward and rearward movements;

a fluid delivery system for delivering a cleaning fluid to the surface to be cleaned;

a fluid recovery system for extracting fluid and debris from the surface to be cleaned through an extraction path to a recovery tank; and an extension with a first end aligned with an inlet for the extraction path and a second end in register with the surface to be cleaned;

wherein movement of the foot assembly in a rearward direction supports the forward portion of the foot assembly on the extension in a first position and movement of the foot assembly in a forward direction shifts support of the forward portion of the foot assembly off of the extension in a second position;

wherein in the first position the extension lifts the forward portion of the foot assembly to reduce the amount of contact that at least one of the at least one rotatable agitator has with the surface to be cleaned.

11. The extractor of claim 10 wherein in the second position the forward portion of the foot assembly is not lifted by the extension and the amount of contact that at least one of the at least one rotatable agitator has with the surface to be cleaned is increased.

12. The extractor of claim 10 wherein, in the first position, the first end of the extension is fluidly coupled with the inlet of the extraction path, and in the second position, the first end of the extension is disengaged from the inlet.

13. The extractor of claim 10 and further comprising a sealing member positioned between the first end of the extension and the inlet of the extraction path.

14. The extractor of claim 10 and further comprising a hinge pivotably mounting the extension to the foot assembly between at least the first and second positions.

15. An extractor comprising:

a foot assembly supported by at least one wheel at a rearward portion thereof and at least one rotatable agitator at a forward portion thereof, wherein the foot assembly is traversed over a surface to be cleaned in alternating forward and rearward movements;

a fluid delivery system for delivering a cleaning fluid to the surface to be cleaned;

a fluid recovery system for extracting fluid and debris from the surface to be cleaned through an extraction path to a recovery tank; and an extension with a first end aligned with an inlet for the extraction path and a second end in register with the surface to be cleaned;

wherein movement of the foot assembly in a rearward direction supports the forward portion of the foot assembly on the extension in a first position and movement of the foot assembly in a forward direction shifts support of the forward portion of the foot assembly off of the extension in a second position; and wherein at least one of the at least one rotatable agitator is in contact with the surface to be cleaned during the forward and rearward movement of the foot assembly.

16. The extractor of claim 15 wherein movement of the foot assembly in the forward direction shifts support of the forward portion of the foot assembly onto the at least one rotatable agitator.

17. The extractor of claim 15 wherein, in the first position, the first end of the extension is fluidly coupled with the inlet of the extraction path, and in the second position, the first end of the extension is disengaged from the inlet.

18. The extractor of claim 15 and further comprising a sealing member positioned between the first end of the extension and the inlet of the extraction path.

19. The extractor of claim 15 and further comprising a hinge pivotably mounting the extension to the foot assembly between at least the first and second positions.

* * * * *